US006398083B2

(12) United States Patent
Nybakke

(10) Patent No.: US 6,398,083 B2
(45) Date of Patent: Jun. 4, 2002

(54) BEVERAGE SERVER WITH THREE POSITION LID

(75) Inventor: Keith G. Nybakke, Minneapolis, MN (US)

(73) Assignee: Service Ideas, Inc., Woodbury, MN (US)

( * ) Notice: Subject to any disclaimer, the term of this patent is extended or adjusted under 35 U.S.C. 154(b) by 0 days.

(21) Appl. No.: 09/814,340

(22) Filed: Mar. 21, 2001

Related U.S. Application Data

(63) Continuation-in-part of application No. 09/311,440, filed on May 14, 1999, now Pat. No. 6,234,364.

(51) Int. Cl.[7] ..... A47G 19/14

(52) U.S. Cl. ..... 222/469; 222/470; 222/475.1; 222/481.5; 222/555

(58) Field of Search ..... 222/465.1, 468, 222/469, 470, 475.1, 481.5, 555

(56) References Cited

U.S. PATENT DOCUMENTS 4,921,146 A * 5/1990 Salzmann ..... 222/473
5,243,194 A * 9/1993 McNamara ..... 222/470
5,497,917 A * 3/1996 Krimmel et al. ..... 222/475.1
5,513,780 A * 5/1996 Buono ..... 222/468
5,653,362 A * 8/1997 Patel ..... 222/475.1
5,988,457 A * 11/1999 Andrew et al. ..... 222/475.1
6,234,364 B1 * 5/2001 Nybakke et al. ..... 222/469

* cited by examiner

*Primary Examiner*—Joseph A. Kaufman
(74) *Attorney, Agent, or Firm*—Moore & Hansen

(57) ABSTRACT

A beverage server comprises a container having a top, a bottom, and side walls joined so as to form a water-tight vessel. The container has a fill opening in the top thereof that provides access to the interior of the container. The container also has a spout formed through a side wall of the container and opening onto the fill opening formed into the top and a handle connected to a side wall of the container opposite the spout. A lid having a top with a skirt wall depending downwardly therefrom is constructed and arranged to be received within the fill opening of the container. The skirt wall has a pour opening formed therethrough that may be aligned with the spout formed through the sidewall of the container to allow liquids to be poured from the beverage server. The lid is rotatable between three positions: a first, open/close position; a second, closed position; and a third, pouring position.

14 Claims, 4 Drawing Sheets

BEVERAGE SERVER WITH THREE POSITION LID

CROSS REFERENCE TO RELATED APPLICATIONS

This application is a continuation-in-part of application Ser. No. 09/311,440 filed May 14, 1999 now U.S. Pat. No. 6,234,364 and entitled Passenger Beverage Server.

FIELD OF THE INVENTION

This invention relates generally to a beverage server that is ideally suited for airline use or to use in situations where a server must be moved a great deal. More specifically, the present invention relates to a beverage server having a three-position lid that, depending on which position the lid is in, can be removed for filing or cleaning of the server, can be closed to conserve liquids within the server, or can be opened to pour beverages from the server.

BACKGROUND OF THE INVENTION

Pouring beverages during a flight present unique problems. Aircraft often encounter areas of vary air pressure that act on the plane to produce abrupt elevation changes. These pressure differences, or turbulence, result in a bumpy ride for the passengers of the airplane and make it difficult to pour beverages such as coffee or tea that are typically packaged in individual containers. Furthermore, turbulence could actually tip over containers that are resting on a cart's surface.

Therefore, it is an object of the present invention to provide a stable beverage server having a low center of gravity and therefore relatively resistant to tipping over. It is another object of the invention to provide a beverage server having a lid that is easily in place and removed yet remains securely in place on the beverage server. Furthermore, it would be desirable to provide a lid for a beverage server that can selectively open or close a pour spout in the beverage server so as to prevent accidental spills.

These and other objectives and advantages of the invention will appear more fully from the following description, made in conjunction with the accompanying drawings wherein like reference characters refer to the same or similar parts throughout the several views.

SUMMARY OF THE INVENTION

A beverage server that meets the objectives of the present invention comprises a container having a top, a bottom, and side walls that are joined so as to form a water-tight vessel. The container has a fill opening in the top thereof that provides access to the interior of the container. A spout is formed through a side wall of the container and opens onto the fill opening formed into the top of the container. A handle is connected to a side wall of the container for manipulating the server. A lid having a top with a skirt wall depending downwardly therefrom is constructed and arranged to be received within the fill opening of the container. The skirt wall will preferably form a water resistant seal with the fill opening of the container.

This skirt wall has a pour opening formed therethrough that may be aligned with the spout formed through the sidewall of the container to allow liquids to be poured from the beverage server. The pour opening preferably has a plurality of ribs formed thereacross that prevent objects such as ice cubes and tea bags from entering the inner passage of the spout.

The lid is rotatable between three positions. The first position of the lid is one in which the skirt wall of the lid may be inserted into and removed from the fill opening. The second position of the lid is one in which the skirt wall of the lid is securely retained in the fill opening of the container and wherein the pour opening of the skirt wall is rotated out of alignment with the spout so as to prevent liquids from exiting the container The third position of the lid is one in which the skirt wall is securely retained within the fill opening of the container and wherein the pour opening of the skirt wall is rotated into alignment with the spout so that liquids may be poured from the container. It is preferable to arrange a handle upon the lid so that when the lid is in its third position, the lid handle is aligned between the spout and the handle. This provides an easy see indication of the position of the lid. The lid will typically rotate between 45 and 90 degrees between its first and third positions. However in the preferred embodiment of the invention the lid will rotate approximately 45 degrees between its first and third positions.

The skirt wall of the lid and the wall of the fill opening have cooperating thread structures formed therein that are constructed and arranged to allow the skirt wall of the lid to be removed and inserted into the fill opening when the lid is rotated into its first position and wherein the skirt wall of the lid is securely retained within fill opening when the lid is rotated into its second and third positions. These thread structures preferably take the form of mating male and female threads. The male and female threads of the thread structures may be formed into either the lid or the fill opening of the container as desired. In addition, the pitch of the threads of the thread structures will be relatively shallow and will preferably be angled at approximately zero degrees.

A protrusion extending from the skirt wall of the lid is constructed and arranged to engage a plurality of detents formed into the fill opening of the container. The interaction of the protrusion and the detents acts to define and positively locate the lid in each of its three positions. Note that the protrusion and the detents may be interchangeably formed in either the lid or the fill opening.

In order to provide for a substantially consistent flow rate of liquids from the server, the lid is provided with an air vent. This air vent is sized relative to the spout such that a substantially consistent flow rate of between 1.5 and 3 ounces of fluid per second may be poured from the spout without regard for the quantity of fluid contained within the server. Preferably the vent and spout will be sized to provide a substantially consistent flow rate of approximately 2 ounces per second. One embodiment of the air vent may include a pointer that is rotatable between a plurality of positions that respectively indicate the type of liquid that is within the container.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

Figure 1:
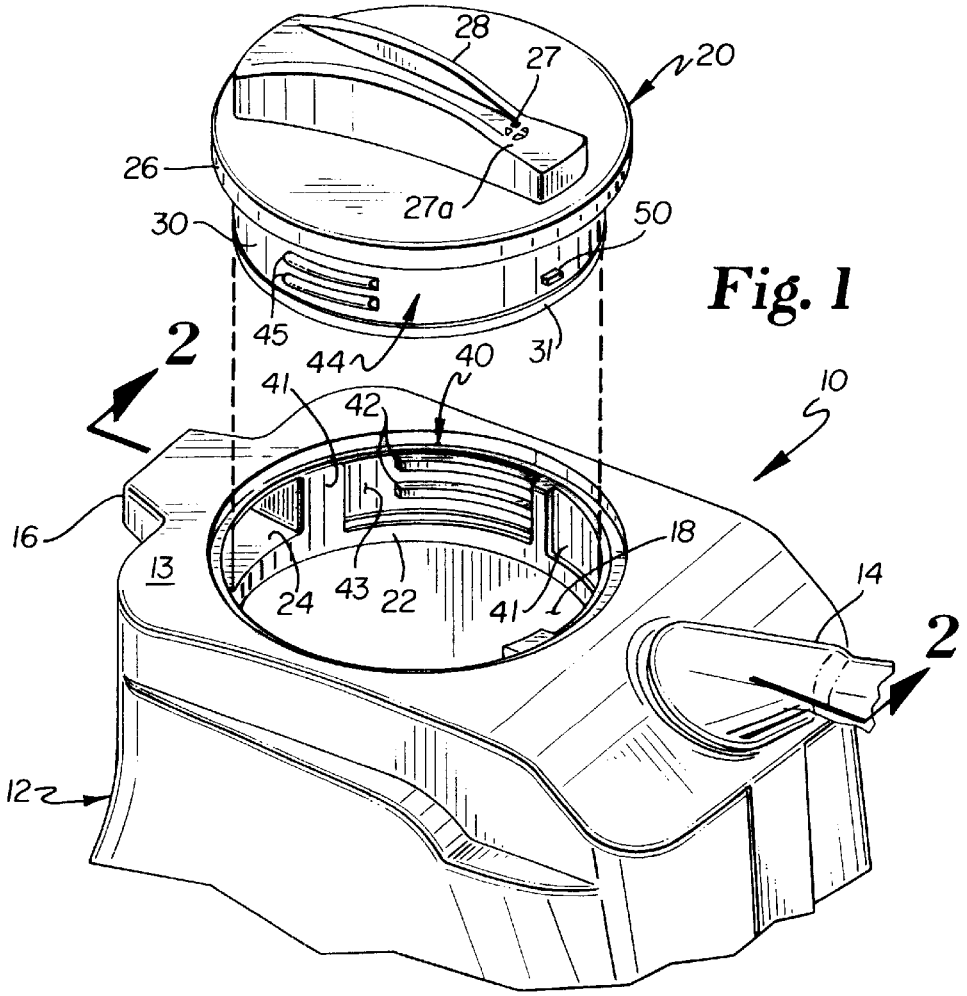
FIG. 1 is a perspective exploded view of a beverage server having a lid constructed and arranged according to the present invention.

FIG. 1 illustrates a beverage server comprising a container 12 having a handle 14 extending from a rear portion of the container 12 and a spout 16 extending from the container 12 near a top portion of the container. The container 12 has a fill opening 18 into which a lid 20 may be inserted. Preferably the container 12 will be insulated so that beverages placed therein will remain hot or cold as the case may be.

Figure 2:
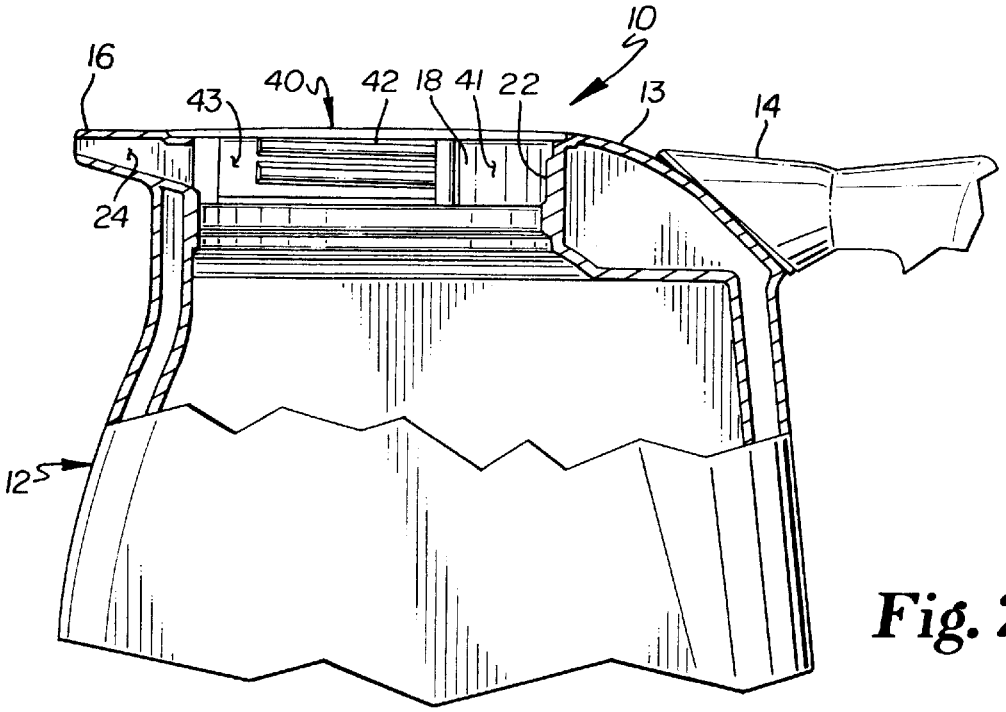
FIG. 2 is a partial cross-sectional view of the upper portion of the beverage server.
Figure 3:
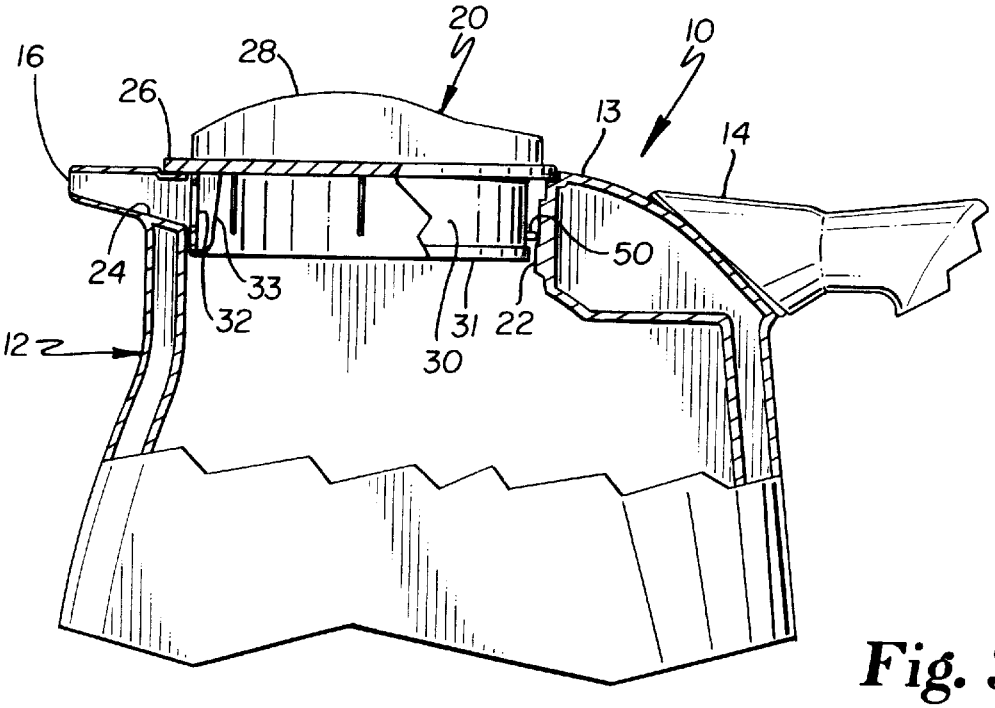
FIG. 3 is a partial cross-section of the upper portion of the beverage server having a lid constructed and arranged according the principles of the present invention received in a fill opening thereof.
Figure 5:
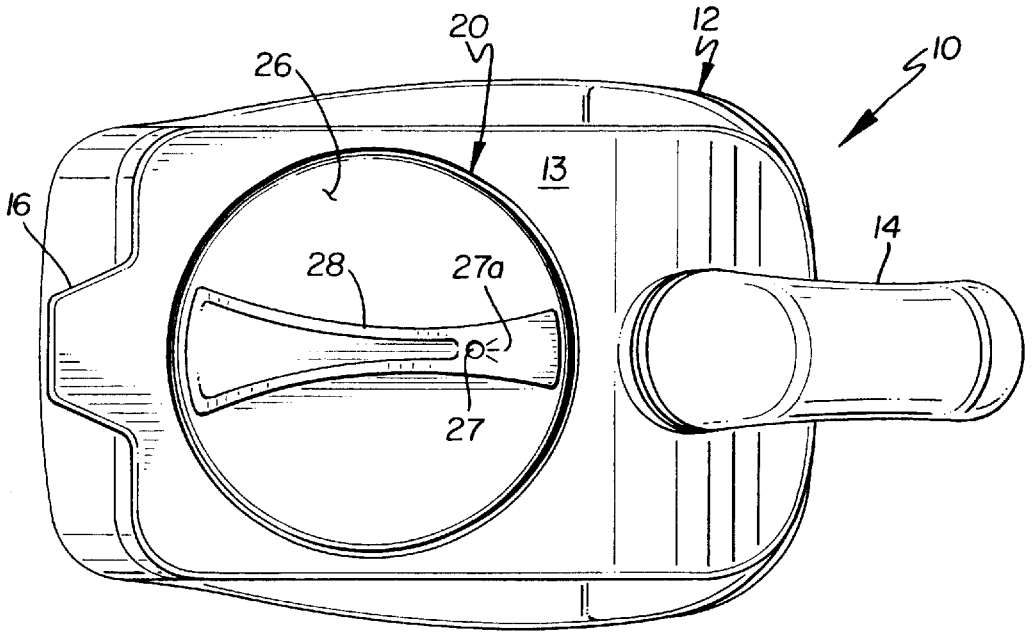
FIG. 5 is a top plan view of the beverage server having received within a fill opening thereof a three position lid of the present invention.
Figure 6:
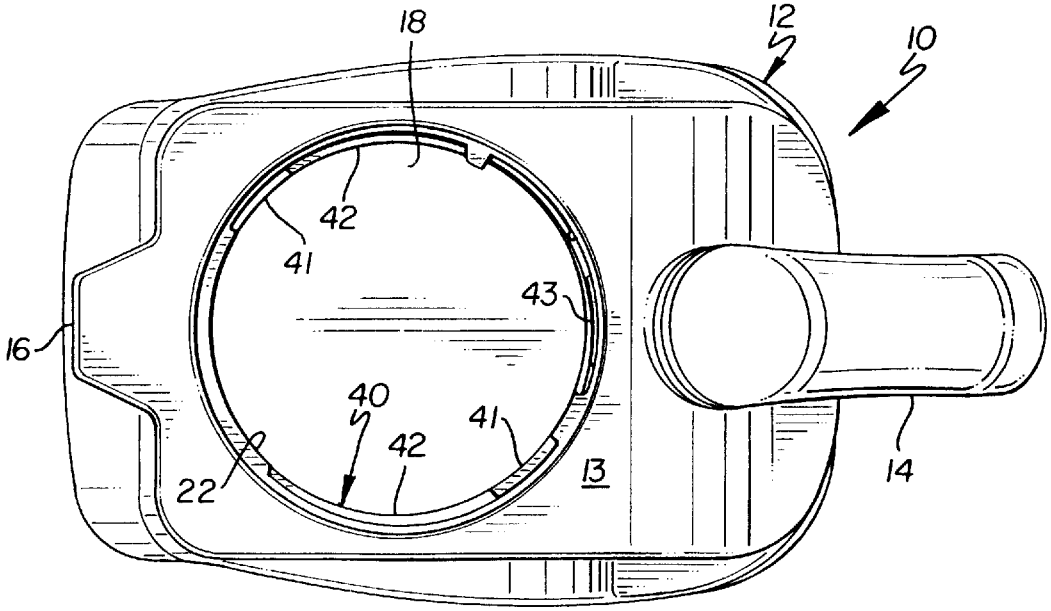
FIG. 6 is a top plan view of the beverage server illustrating the fill opening thereof wherein the female thread portions are arranged in a left-handed orientation.
Figure 7:
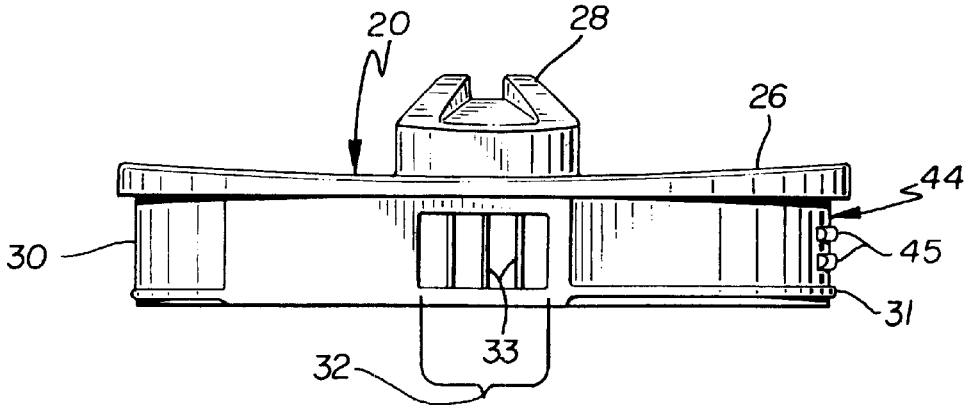
FIG. 7 is a front elevation of the lid of the beverage server showing the pour opening thereof; and, FIG. 8 is a perspective view of the fill opening of the beverage server illustrating the detents that define the three positions of the lid of the server.
Figure 8:
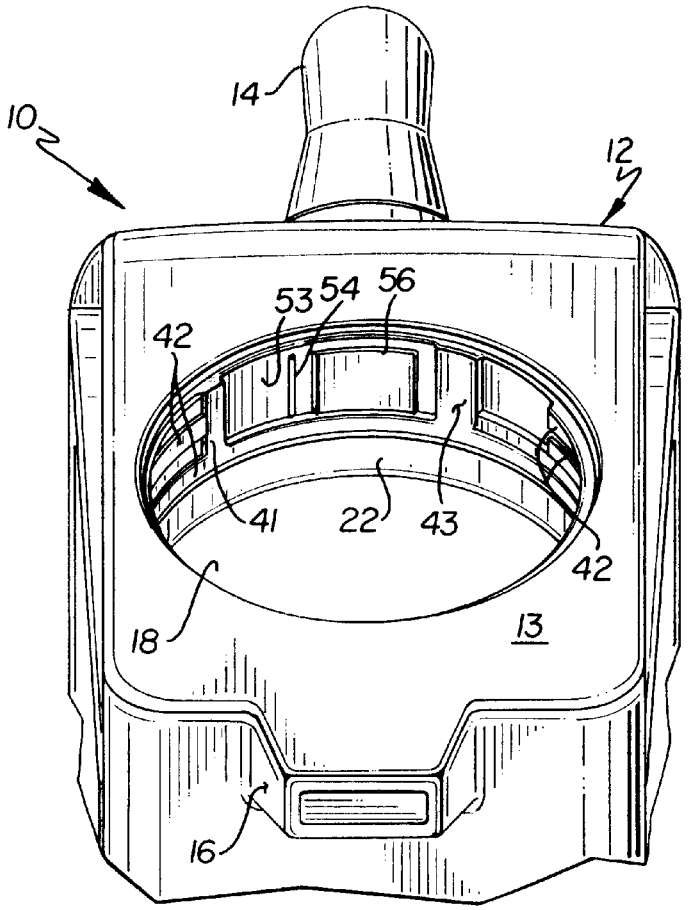

The fill opening 18 of the server 10 extends downwardly into the top portion 13 of the container 12. As can be best seen in FIG. 2, fill opening 18 extends downwardly into top 13 and forms a peripheral wall 22 that extends around the fill opening 18. The peripheral wall 22 of fill opening 18 is sufficiently large, i.e. has a sufficient height, to provide for the application of means for retaining the lid 20 thereto. In addition, spout 16 has an inner passage 24, which opens through the peripheral wall 22 of the fill opening 18.

Lid 20 essentially comprises a top 26 that is in the preferred embodiment substantially circular in shape. A top handle 28 extends upwardly from the top 26 to provide a user of the server 10 a means whereby to manipulate the lid 20. Depending downwardly from the underside of the top 26 is a cylindrical skirt 30. This skirt 30 comprises retaining means that cooperate with retaining means formed into the peripheral wall 22 of the fill opening 18, a means for maintaining the lid in one of three positions, and a pour opening 32 formed through the skirt 30 that may be positioned to communicate with passage 24 of spout 16.

A vent 27 is formed through the top 26 of lid 20 to permit atmospheric air to enter the container 12 as liquids are poured therefrom through the spout 16. It has been found that in pouring liquids from an unvented container 12, it is necessary to increase the angle at which the container 12 is held to maintain a substantially consistent pour rate. This can be difficult to do in the crowded and sometimes turbulent confines of the aisle of an aircraft. Therefore, the vent 27 and the inner passage 24 of the spout 16 are constructed and arranged to permit a standard pour rate of between 1.5 and 3 ounces of liquid per second regardless of how full the container 12 is. More preferably the pour rate will be approximately 2 ounces of liquid per second. By limiting the flow rate of liquid poured from the server 10, a user of the server 10 maintains more control thereover. This, in turn, results in fewer spills. Note that the vent 27 illustrated in the Figures is a simple hole bored through the lid top 26. While this is sufficient for the purposes of controlling the flow of liquids from the server 10, it is preferred to cover or otherwise protect the vent 27. Such protection may take the form of a grate or a small cover suspended over the vent 27. Another embodiment of vent 27 may take the form of a pointer for indicating the type of liquid that is within the container 12. Such a pointer would preferably be mounted on a stem that is rotatively retained within a vent hole 27. The gaps formed between the stem of the pointer and the vent hole 27 would then act to allow for the entry of air into the container 12. The pointer would be rotatable between a plurality of positions that correspond to a particular type of liquid. Each of the positions may be further highlighted by forming letter or other indices into the lid top 26. One example would include indices for regular coffee, decaffeinated coffee, and other liquids.

Skirt 30 of lid 20 is retained within the fill opening 18 by cooperative retaining means that preferably comprise a shallow thread structure formed into the skirt 30 of the lid 20 and into the peripheral wall 22 of fill opening 18. Preferably a female portion of the thread structure is formed into the peripheral wall 22 of fill opening 18 as illustrated in FIG. 1 and the male portion of the thread structure is formed into the skirt 30 of the lid 20. Note that the pitch or angle of the thread structures will be relatively shallow and may even be flat. This is to allow for rotation of the lid 20 through its three positions. The thread structure may be right or left handed, but, in accord with common usage, is preferably right handed so as to allow lid 20 to be rotated clockwise as it is inserted.

The female thread portion 40 illustrated in FIG. 1 is formed within a recess 41 that extends into the peripheral wall 22. Female threads 42 extend inwardly from the recessed portion 41 of the peripheral wall 22 to a point that is flush or slightly inset from the surface of the peripheral wall 22. The female threads 42 do not extend entirely across the recess 41 and there exists an open space 43 within recess 41 that permits the insertion of a male thread element 44. Typically there will be at least two female thread elements 42 formed in the recess 41 though one female thread element 42 may suffice. Preferably, there will exist two female thread portions 40 in the peripheral wall 22 so that the lid 20 may be securely retained within the fill opening 18. These female thread portions 40 will be substantially identical.

Figure 4:
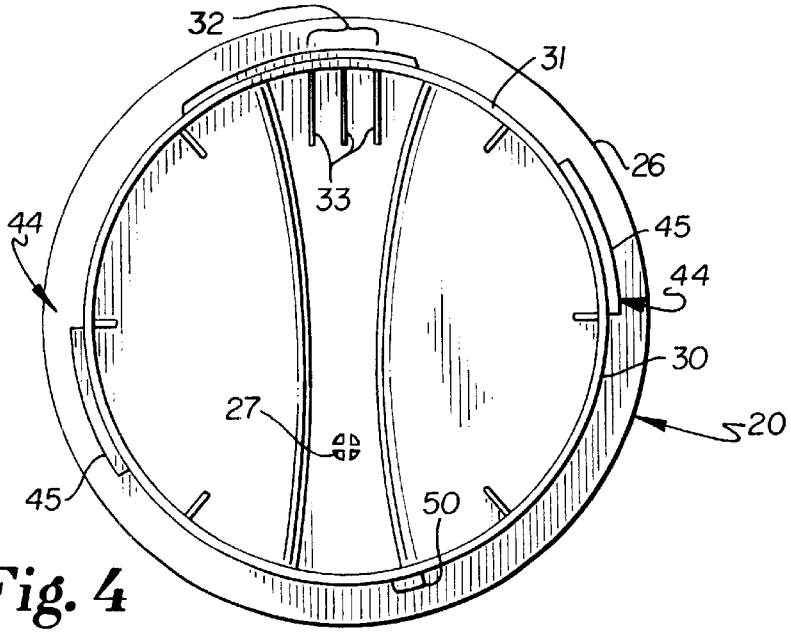
FIG. 4 is a bottom plan view of a lid constructed according to the present invention.

Extending outwardly from the wall 30 of lid 20 are male thread portions 44. As can be seen in FIG. 4, there are two sets of male thread portions 44 provided on the wall 30 of the lid 20, the number of sets of male thread portions 44 corresponding to the number of female thread portions 40. These male thread portions 44 comprise one or more male thread elements 45 that are constructed and arranged to mate with the female thread elements 42 to secure the lid 20 within the fill opening 18. As indicated above, the pitch of the male and female thread elements 45, 42 is relatively shallow. The exact pitch of these thread elements will be limited only by the need to rotate the lid between its three positions without becoming too tight to prevent rotation or becoming so loose as to permit unwanted rotation.

The skirt 30 of the lid 20 is sized to fit within the fill opening 18 in a relatively close fitting relationship with the peripheral wall 22 of the fill opening 18. While a water-tight interface between the lid 20 and container 12 may be desirable, that tight a seal is not necessary. As the skirt 30 of lid is inserted into the fill opening 18, the lid 30 must be rotated such that male thread elements 45 engage the open area 43 of recesses 41 in the peripheral wall 22. In this manner, the skirt 30 of the lid 20 may be inserted fully into the fill opening 18. In addition, it is preferred to set the distance from the underside of the lid top 26 to the male thread elements 45 such that the underside of the lid top 26 will contact the upper surface of the container 12 when the lid 20 is placed thereon. Once the skirt 30 of the lid has been fully inserted into the fill opening 18 the user grasps top handle 28 and rotates the lid 20 in such a manner that the male and female threads engage, thereby preventing lid 20 from being pulled from the fill opening 18.

The position of the lid 20 in which the male thread elements 45 are aligned with and inserted into the open areas 43 of the recesses 40 represents a first position of the lid 20. This is the first, open/close position of the lid 20. When the lid 20 is in this position, it may be placed onto, or removed from the container 12 for filling or cleaning the container 12.

Skirt 30 is provided with a protrusion 50 that extends outwardly therefrom for the purpose to positively locating the lid 20 in its three positions. This protrusion 50 is sized and positioned upon skirt 30 so as to be received in an open area 53 of a recess 52 formed into the peripheral wall 22 of the fill opening 18 when the lid 20 is in its first, open/close position.

Detents 54 and 56 within recess 52 define positions two and three for the three positioned lid 20. As lid 20 is rotated clockwise from its first, open/close position, protrusion 50 will encounter detent 54. Because the material from which the lid 20 and fill opening 18 are fashioned is relatively elastic, protrusion 50 may be forced over and past detent 54 to a position in which the protrusion 50 is located between detents 54 and 56. As the protrusion 50 is moved past detent 54, female and male thread elements 42 and 45 will engage one another so as to prevent the lid 20 from being pulled from the fill opening 18. The position of the lid 20 wherein the protrusion 50 is located between detents 54 and 56 is the second, closed position of the lid 20. Note that in both its first, open/close position and its second, closed position, pour opening 32 is rotated away from the passage 24 of spout 16. Therefore, in its first and second positions, no fluid within the container 12 may exit the container through the spout 16.

As the lid 20 is rotated clockwise from its second position, protrusion 50 encounters detent 56. Again, because of the elastic nature of the lid 20 and the fill opening 18, protrusion 50 may be rotated over and past detent 56 to a third, pour position. In this third, pour position, pour opening 32 is rotated into alignment with the passage 24 of spout 16 such that fluid within the container 12 may be poured therefrom through spout 16. Note that the male and female thread portions of the lid 20 and fill opening 18 remain securely engaged so that lid 20 may not be removed from the fill opening 18.

Ribs 33 are secured across the pour opening 32 inside skirt 30 of lid 20. These ribs 33 do not block the flow of liquids from the container 12 but instead prevent solids such as ice, tea bags or the like from being pour from the container 12 when the lid 20 is in its third, pour position. These ribs 33 are not necessary but are preferably a part of lid 20.

Preferably lid 20 will rotate through no more than 90 degrees in moving between its first and third positions although where the male and female thread portions of the lid 20 and fill opening 18 have a flat pitch larger rotations may be possible. More preferably, the lid 20 will rotate no more than 45 degrees between its first and third positions. Essentially, the range of rotation of the lid 20 is dictated by the relative sizes of the pour opening 32 and passage 24 of spout 16. Where the pour opening 32 and passage 24 are relatively large, the range of rotation of the lid 20 will be correspondingly large so as to prevent the flow of liquids from the container when the lid is in its first and second positions. Note that the lower edge 31 of skirt 30 is sized so as to form a substantially water resistant seal with the lower portion of the fill opening 18. In this manner, liquids within a server 10 will not likely spill as the liquids within the container 12 will pass into the lid 20 rather than out of the fill opening 18. Furthermore, when the lid 20 is in its second, closed position, the pour opening 32 will be rotated away from the spout 16 and it will be difficult for liquids to pass through the pour opening 32, between the skirt 30 and fill opening 18 and out of spout 16. In the preferred embodiment of the present invention, the server 10 will be only leak resistant, though, as indicated above, the server 10 may be constructed so as to be substantially spill proof.

In use a liquid is placed in the container 12 and the lid 20 is placed in the fill opening 18 of the container 12 in its first, open/close position. The user then grasps the lid handle 28 and rotates the lid 20, preferably clockwise, so that the male and female thread portions of the lid 20 and fill opening 18 engage each other and protrusion 50 is rotated over and past detent 54 until lid 20 is in its second, closed position wherein protrusion 50 is located between detents 54 and 56. The user will preferably rotate the lid 20 between 22 and 45 degrees to move the lid 20 from its first position to its second position. With lid 20 in its second, closed position, the server 10 may safely be moved or stored as on an airline beverage cart without fear of unwanted spillage. When the user desires to pour a beverage, the user again grasps the lid handle 28 and rotates the lid 20, again clockwise, such that protrusion 50 moves over and past detent 56 and protrusion 50 is located between 56 and the edge of the recess 52. Preferably the user will rotate the lid 20 through 22–45 degrees to move the lid 20 from its second, closed position to its third, open position. Also, it is preferred to arrange the lid handle 28 upon the lid 20 such that the lid handle 28 is aligned between spout 16 and handle 14 when the lid 20 is in its third position. This arrangement allows the user to quickly and reliably determine the position of the lid 20 within fill opening 18. When the user has finished pouring a beverage from the server 10, the lid 20 will be moved from its third, open position back to its second, closed position so that liquids in the container 12 may not spill.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A beverage server comprising:

a container having a top, a bottom, and side walls joined so as to form a water-tight vessel, the container having a fill opening in the top thereof that provides access to the interior of the container;

a spout formed through a side wall of the container and opening onto the fill opening formed into the top;

a handle connected to a side wall of the container; and, a lid having a top with a skirt wall depending downwardly therefrom, the skirt wall being constructed and arranged to be received within the fill opening of the container, the skirt wall having a pour opening formed therethrough that may be aligned with the spout formed through the sidewall of the container to allow liquids to be poured from the beverage server when the skirt wall of the lid is received in the fill opening of the container, the lid being rotatable between three positions, the first position being one in which the skirt wall of the lid may be inserted into and removed from the fill opening, the second position being one in which the skirt wall of the lid is securely retained in the fill opening of the container and wherein the pour opening of the skirt wall is rotated out of alignment with the spout thereby preventing liquids from exiting the container, and the third position being one in which the skirt wall is securely retained within the fill opening of the container and wherein the pour opening of the skirt wall is rotated into alignment with the spout so that liquids may be poured from the container.

2. The beverage server of claim 1 wherein the skirt wall of the lid and the wall of the fill opening have cooperating thread structures formed therein constructed and arranged to allow the skirt wall of the lid to be removed and inserted into the fill opening when the lid is rotated into its first position and wherein the skirt wall of the lid is securely retained within fill opening when the lid is rotated into its second and third positions.

3. The beverage server of claim 1 wherein the lid further comprises a lid handle that is arranged upon the lid such that when the lid is in its third position, the lid handle is aligned between the spout and the handle.

4. The beverage server of claim 1 wherein the lid rotates between 45 and 90 degrees between its first and third positions.

5. The beverage server of claim 1 wherein the lid rotates approximately 45 degrees between its first and third positions.

6. The beverage server of claim 1 wherein the lid further comprises a plurality of rib members located across the pour opening thereof, the rib members permitting the flow of liquids through the pour opening and yet preventing the flow of solids from the container.

7. The beverage server of claim 1 wherein the lid further comprises a protrusion that is constructed and arranged to engage a plurality of detents that are formed into a side wall of the fill opening, the detents defining the relative angles of the three positions of the lid.

8. The beverage server of claim 2 wherein the cooperative thread mechanisms have a thread pitch of approximately zero degrees.

9. The beverage server of claim 1 wherein a side wall of the fill opening further comprises a protrusion that is constructed and arranged to engage a plurality of detents that are formed into the lid of the server, the detents defining the relative angles of the three positions of the lid.

10. The beverage server of claim 1 wherein there is formed a substantially water resistant seal between the skirt of the lid and the fill opening of the container.

11. The beverage server of claim 1 wherein the lid further comprises an air vent.

12. The beverage server of claim 11 wherein the air vent of the lid is sized relative to the spout of the server such that a substantially consistent flow rate of between 1.5 and 3 ounces of fluid per second may be poured from the spout without regard for the quantity of fluid contained within the server.

13. The beverage server of claim 12 wherein the air vent of the lid is sized relative to the spout of the server such that a substantially consistent flow rate of approximately 2 ounces per second may be poured from the spout without regard for the quantity of fluid contained within the server.

14. The beverage server of claim 11 wherein the air vent is sized to receive therein a stem of a pointer that is rotatable between a plurality of positions that respectively indicate the type of liquid that is within the container.

* * * * *